US007178293B2

(12) United States Patent
Kim

(10) Patent No.: US 7,178,293 B2
(45) Date of Patent: Feb. 20, 2007

(54) GASKET HAVING ELASTIC CONNECTION PORTION FOR REFRIGERATOR DOORS

(75) Inventor: Young-Nam Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/090,278

(22) Filed: Mar. 28, 2005

(65) Prior Publication Data

US 2005/0223646 A1 Oct. 13, 2005

(30) Foreign Application Priority Data

Mar. 29, 2004 (KR) ..... 10-2004-0021337
Jun. 8, 2004 (KR) ..... 10-2004-0041976

(51) Int. Cl.
*E06B 7/18* (2006.01)

(52) U.S. Cl. ..... 49/478.1; 277/629; 277/921

(58) Field of Classification Search ..... 49/478.1, 49/498.1, 475.1, 368; 312/405, 296; 277/410, 277/629, 644, 645, 921
See application file for complete search history.

(56) References Cited

U.S. PATENT DOCUMENTS 2,767,040 A * 10/1956 Kesling ..... 312/296
3,048,902 A * 8/1962 Hastings et al. ..... 49/402
3,078,134 A * 2/1963 Haynes, Jr. ..... 312/296
3,487,581 A * 1/1970 Ellingson, Jr. ..... 49/478.1
4,138,049 A * 2/1979 McAlarney ..... 277/629
5,816,080 A * 10/1998 Jeziorowski ..... 62/441
5,916,076 A * 6/1999 Cittadini et al. ..... 49/492.1

* cited by examiner

*Primary Examiner*—Gregory J. Strimbu
(74) *Attorney, Agent, or Firm*—Birch, Stewart, Kolasch & Birch, LLP

(57) ABSTRACT

A gasket for a refrigerator includes a pivotable flexible gasket main body extending in a longitudinal direction, the gasket main body having a front contact side portion and a rear side portion opposite to the front contact side portion, the front contact side portion of the gasket being contactable with a front contact side portion of another gasket to form a contact interface; an elastic portion formed in the gasket main body, the elastic portion having an elastic connection portion, the elastic connection portion extending from the front contact side portion to the rear side portion; and a magnet provided within the gasket main body and located on the front contact side portion of the gasket main body.

9 Claims, 6 Drawing Sheets

GASKET HAVING ELASTIC CONNECTION PORTION FOR REFRIGERATOR DOORS

BACKGROUND OF THE INVENTION

1. Field of Invention

The present invention relates to a refrigerator. More particularly, the present invention relates to a gasket used in a refrigerator in which a single storage space is opened and closed by two doors, and a storage space sealing structure using the same.

2. Description of the Prior Art

A refrigerator maintains an interior of a storage space at a predetermined temperature, and thus keeps stored goods fresh. There are various kinds of refrigerators. Lately, a refrigerator in which a single storage space is opened and closed by two doors has also come into the market. FIGS. 1 and 2 show a refrigerator according to a prior art in which a single storage space is opened and closed by two doors.

As shown in the figures, the interior of a refrigerator main body 1 is vertically divided into a refrigerating chamber 3 and a freezing chamber 5. A plurality of shelves 11 and accommodation boxes 13 are installed in the refrigerating and freezing chambers 3 and 5 in order to accommodate foods. The refrigerating and freezing chambers 3 and 5 are selectively opened and closed by first and second refrigerating chamber-doors 7 and 7' and a freezing chamber door 9, respectively. The first and second refrigerating chamber doors 7 and 7' are opened and closed in such a way that their distal ends facing each other pivot about their proximal ends connected to both side ends of the refrigerator main body 1. The freezing chamber door 9 may be forwardly drawn in a sliding manner. Reference numerals 7*a*, 7'*a*, and 9*a* designate door handles.

When the refrigerating chamber doors 7 and 7' are closed, in order to prevent cold air in the refrigerating chamber 3 from leaking out, there are provided gaskets Ga and Gc. The gaskets Ga and Gc consist of the side gaskets Ga provided on the respective distal ends of the refrigerating chamber doors 7 and 7' adjacent to each other, and the rear gaskets Gc provided on respective rear surfaces of the refrigerating chamber doors 7 and 7' corresponding to a front surface of the refrigerator main body 1. The gaskets Ga and Gc are magnetic.

In the meantime, as a sectional view taken along line III–III' of FIG. 1, FIG. 3 shows a portion where the side gaskets Ga provided on side surfaces of the respective distal ends of the refrigerating chamber doors 7 and 7' are in contact with each other. As shown in the figure, portions of the side surfaces and the front surfaces of the refrigerating chamber doors 7 and 7' are defined by outer plates 20, and the inner or rear surfaces thereof are defined by door liners 24. Each of the outer plates 20 consists of a front surface portion 21 defining the front surface thereof and a side surface portion 22 defining the side surface thereof. Each internal space defined by the outer plate 20 and the door liner 24 is formed with an insulating layer 24'. An insertion flange portion 23 is formed on a distal end of each side surface portion 22 to extend vertically in parallel with each front surface portion 21.

The respective side surfaces of the refrigerating chamber doors 7 and 7' facing each other are provided with door brackets 25. The respective door brackets 25 are formed with a length corresponding to a vertical length of the refrigerating chamber doors 7 and 7', and thus define portions of the side surfaces of the refrigerating chamber doors 7 and 7'. The door brackets 25 are formed with vertically elongated insertion grooves 26 into which the insertion flange portions 23 are inserted, respectively. Flange portions 27 are provided at opposite sides of the insertion grooves 26 to be brought into close contact with inner surfaces of the door liners 24, respectively.

Outer surfaces of the door brackets 25 are formed with installation spaces 28 concaved toward the insulating layers 24', respectively. The installation space 28 extends in the lengthwise direction of the door bracket 25. The installation space 28 is formed so that a width of an inlet side thereof is relatively narrower than that of an inner side thereof. A gasket holder 30 is installed in each of the installation spaces 28. The gasket holder 30 extends in the lengthwise direction of the installation space 28. The gasket holder 30 is made of metal or synthetic resin with a predetermined hardness. When the gasket holder 30 is shown as a sectional plan view, a hinge hole 30' is formed at an end of each of the gasket holders 30 corresponding to the refrigerating chamber 3 side. Each of the door brackets 25 are provided with a hinge shaft 31 positioned in the hinge hole 30'. Thus, the gasket holder 30 may pivot about the hinge shaft 31.

Ends of the gasket holders 30 opposite to the hinge holes 30' are formed with protruding stoppers 32, respectively. The stopper 32 serves to be caught on a side of the interior of the installation space 28 so that the gasket holder 30 does not protrude out of the installation space 28. The gasket holder 30 tends to rotate in the direction to protrude out of the installation space 28 by an elastic member. A mounting channel 33 is formed in each of the gasket holders 30 in the lengthwise direction thereof. The mounting channel 33 is opened to the inlet of the installation space 28, and has an inlet that is narrower than an inner side thereof.

The gasket holders 30 are mounted with the side gaskets Ga. A gasket main body Gb of each of the side gaskets Ga has flexibility, and a magnet Mg is provided in the gasket main body Gb. A mounting rib Gr is formed on a surface of each of the gasket main bodies Gb in the lengthwise direction. The mounting rib Gr is formed with a cross section corresponding to that of the interior of the mounting channel 33. Thus, the mounting rib Gr is inserted into the mounting channel 33, so that the side gasket Ga is mounted to the gasket holder 30. Reference numeral 35 not described designates door covers.

However, the above prior art has the following problems.

In the prior art, the side gaskets Ga are rotatably installed in the installation spaces 28 of the door brackets 25. However, if the side gaskets Ga is to be rotatably installed, the installation spaces 28 cannot be completely sealed. Therefore, there is a problem in that cold air leaks out through the side gaskets.

In addition, when the first or second refrigerating chamber door 7 or 7' is opened or closed, the side gaskets Ga of the respective doors 7 and 7' come into close contact with each other and thus the gasket holders 30 pivot on the hinge shafts 31, so that distal ends thereof swing into the installation spaces 28, respectively. However, if the gasket holders 30 excessively pivot, the gasket holders 30 collide against inner surfaces of the installation spaces 28, thereby producing noises. It is the reason why the gasket holders 30 and the door brackets 25 have a predetermined hardness.

Furthermore, according to the prior art, the magnets Mg are provided throughout entire surfaces of the gasket main bodies Gb which are brought into close contact with each other. Thus, since a magnetic force of the magnets Mg acts on the whole of the gasket main bodies Gb that are in close contact with each other, the magnetic force is relatively large. Accordingly, there is a problem in that it is relatively difficult to open the refrigerating chamber doors 7 and 7'.

In addition, the magnets Mg have the predetermined hardness, which causes the flexibility of the gasket main bodies Gb to be reduced. Since the magnets Mg are also provided at the interiors of portions of the gasket main bodies Gb which first come into contact with each other when the refrigerating chamber doors 7 and 7' are closed (or portions of the gasket main bodies Gb which lastly comes apart from each other when the refrigerating chamber doors 7 and 7' are opened), there is a problem in that such portions are severely worn out or damaged. In particular, since the portions of the gasket main bodies Gb, which first come into contact with each other or lastly come apart from each other when the refrigerating chamber doors 7 and 7' are opened or closed, are adjacent to the hinge shafts 31 on which the door brackets 25 pivot, the collision force between the gasket main bodies Gb becomes large.

SUMMARY OF THE INVENTION

Accordingly, the present invention is conceived to solve the aforementioned problems in the prior art. An object of the present invention is to relatively reduce areas of gaskets which are brought into contact with each other by magnets to prevent cold air from leaking out between doors.

Another object of the present invention is to minimize collision caused from the pivoting operation of gaskets for sealing a gap between two doors of a refrigerator in which a storage space is opened and closed by the two doors.

A further object of the present invention is to more completely seal a gap between two doors of a refrigerator in which a storage space is opened and closed by the two doors.

According to an aspect of the present invention for achieving the objects, there is provided a storage space sealing structure for a refrigerator in which a single storage space in a main body of the refrigerator is opened and closed by a pair of doors, comprising: installation spaces depressed to extend along opposite side surfaces of the doors, respectively; gasket holders, each of which is installed in the installation space so that a distal end thereof can pivot about a proximal end thereof toward the inside of the installation space and tends to pivot toward the outside of the installation space; and gaskets provided on side surfaces of the gasket holders, respectively, and brought into contact with each other when the doors close the storage space, each of said gaskets being provided with a magnet at a portion of the contact surface of the gasket opposite to the storage space.

Preferably, the installation space is formed by causing a portion of a door bracket to be depressed into the door, said door bracket defining an external appearance of the side surface of the door.

More preferably, a free end of the gasket holder is formed with a catching stopper which in turn is caught on a stopper formed on an inlet of the installation space, whereby the free end of the gasket holder is prevented from protruding out of the installation space.

More preferably, each of the gaskets comprises: a flexible gasket main body extending in a longitudinal direction; an elastic portion formed in the gasket main body adjacent to the storage space; the magnet provided within the gasket main body and positioned at a region far way from the elastic portion on a side surface of the gasket main body which is in contact with a counterpart gasket main body; and a mounting rib formed on an outer surface of the gasket main body to extend in a longitudinal direction and inserted into and caught in the gasket holder.

More preferably, an elastic connection portion through which both ends of the interior of the gasket main body are connected is formed in the elastic portion to reinforce the elasticity of the elastic portion.

More preferably, a spacer is installed in the installation space, the spacer being having a predetermined cushioning function.

More preferably, the spacer is provided at least on an inner surface of the installation space corresponding to the distal end of the gasket holder.

According to an aspect of the present invention for achieving the objects, there is provided a gasket for a refrigerator, comprising: a flexible gasket main body extending in a longitudinal direction; an elastic portion formed in the gasket main body adjacent to the storage space; and a magnet provided within the gasket main body to extend in a longitudinal direction and positioned at a region far away from the elastic portion on a side surface of the gasket main body which is in contact with a counterpart gasket main body.

Preferably, an elastic connection portion through which both ends of the interior of the gasket main body are connected is formed in the elastic portion to reinforce the elasticity of the elastic portion.

More preferably, a mounting rib is formed on an outer surface of the gasket main body to extend in a longitudinal direction, thereby causing the gasket main body to be fixed at a predetermined position.

According to the present invention so configured, in a refrigerator in which a storage space is opened and closed by two doors, there are advantages in that damage of side gaskets, which are provided at distal ends of the doors and come into contact with each other, is minimized, operating noises of the side gaskets producing when the doors are opened and closed are eliminated, and there is no leakage of cold air since the sealing between the doors is more completed.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a gasket for a refrigerator according to the present invention and a storage space sealing structure using the same will be described in detail with reference to the accompanying drawings.

Figure 1:
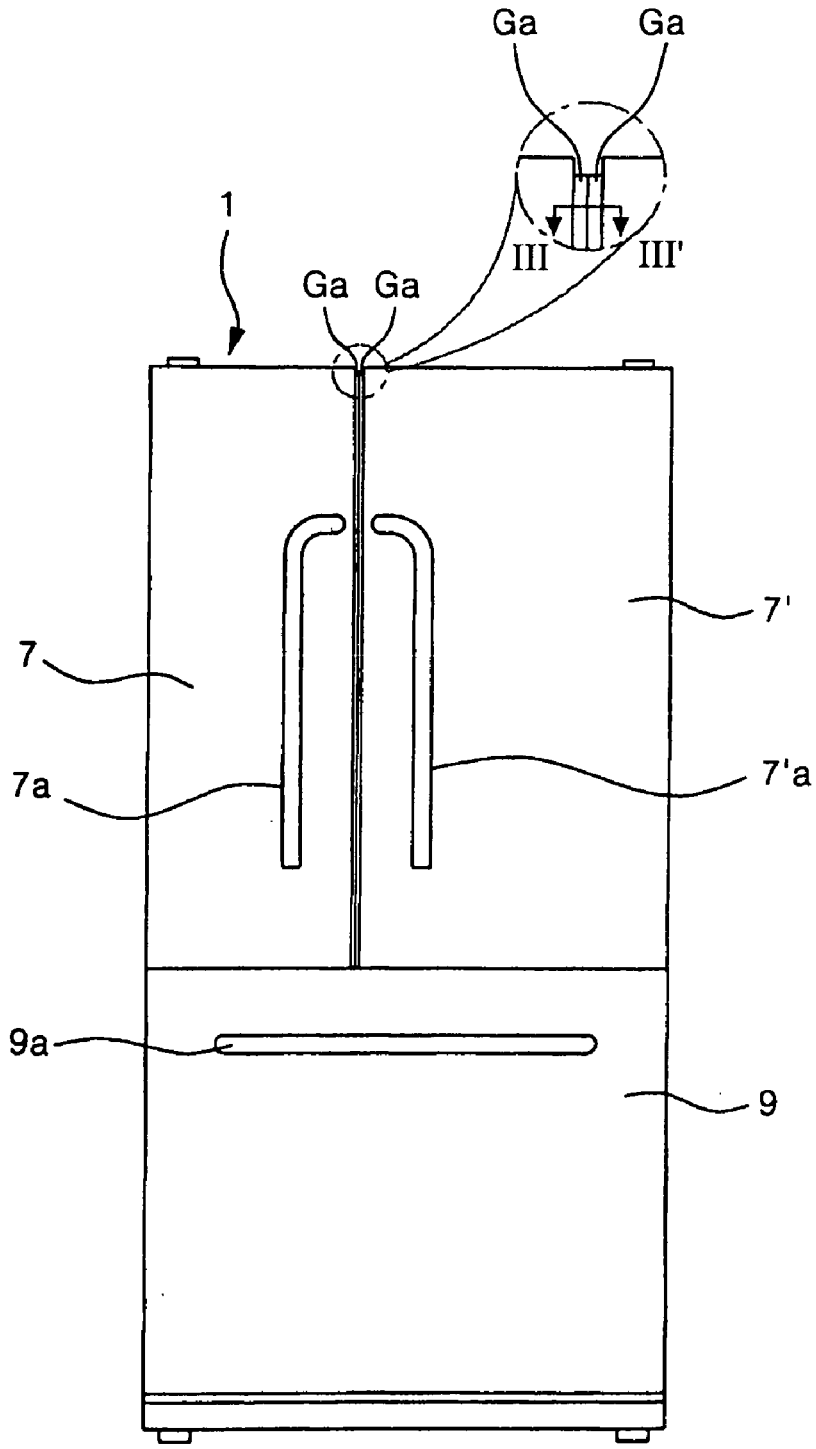
FIG. 1 Related Art
FIG. 1 is a front view of an external appearance of a refrigerator according to a prior art.
Figure 2:
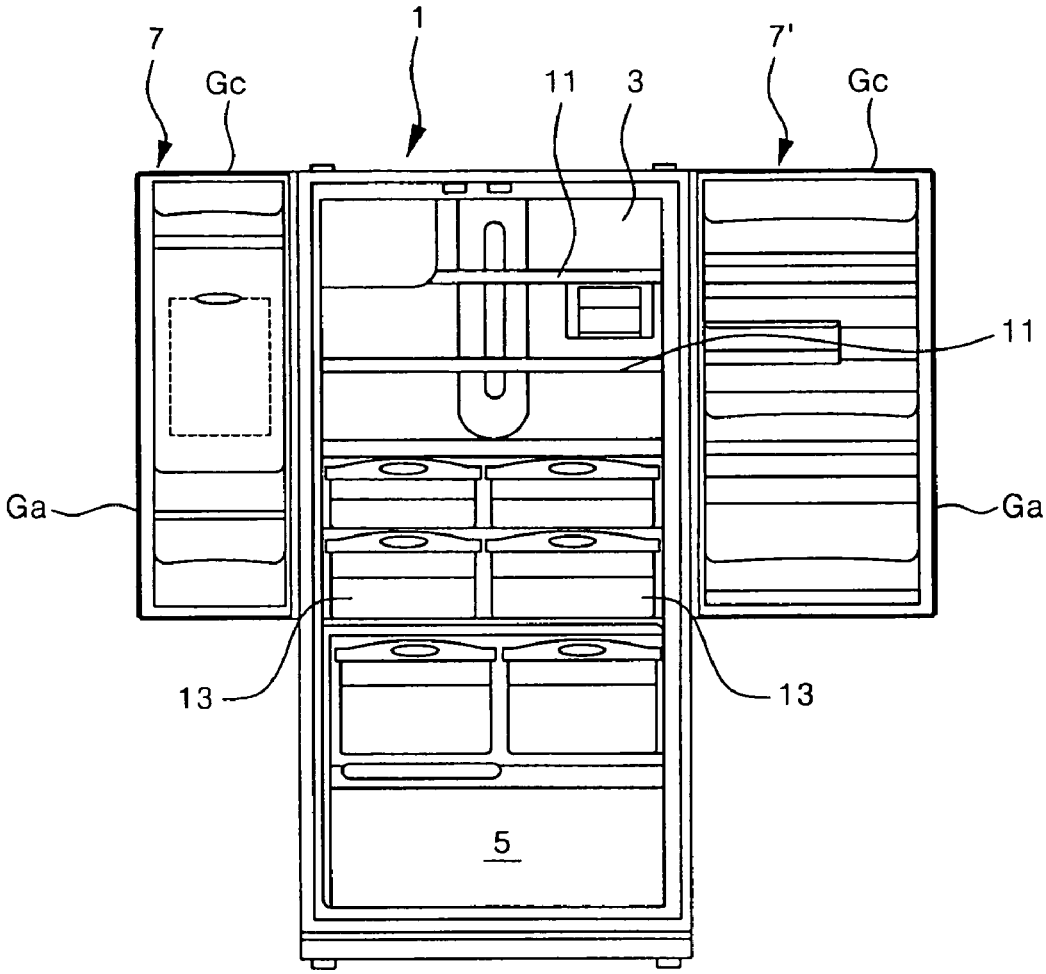
FIG. 2 Related Art
FIG. 2 is a front view of an interior of the refrigerator shown in FIG. 1.
Figure 3:
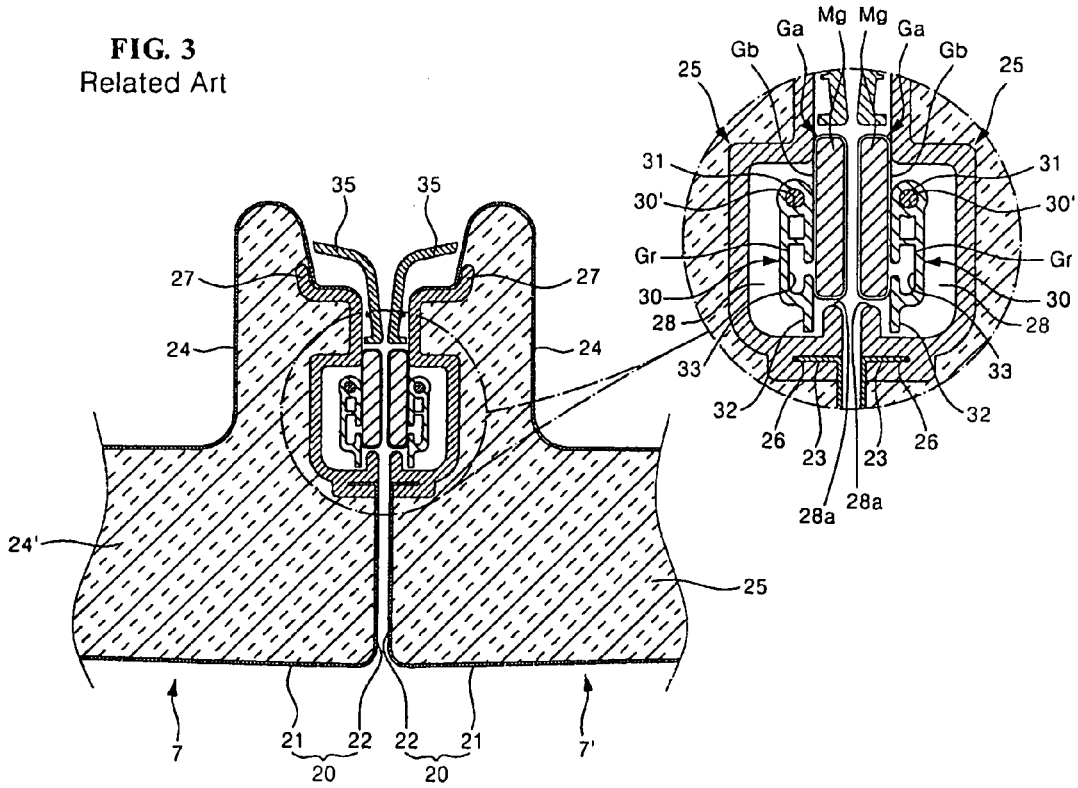
FIG. 3 Related Art
FIG. 3 is a sectional view taken along line III–III' of FIG. 1.
Figure 4:
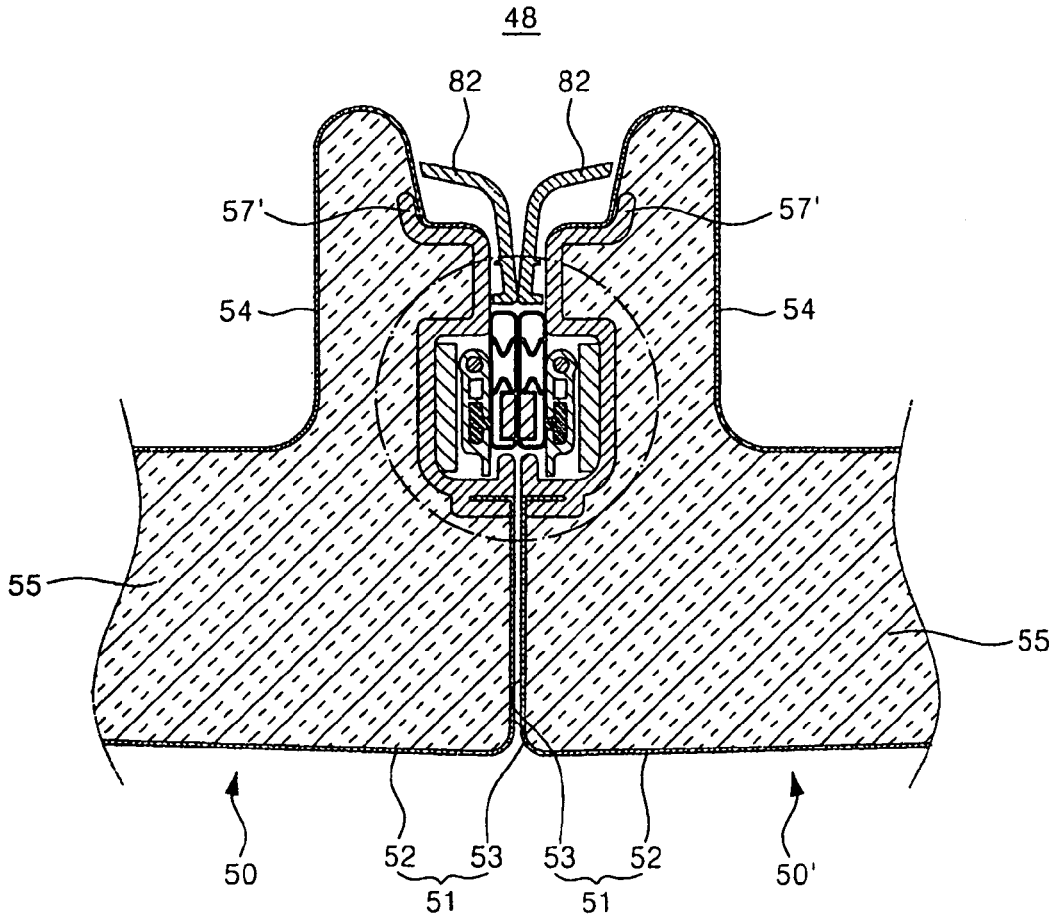
FIG. 4 is a cross sectional view of a preferred embodiment of a storage space sealing structure for a refrigerator according to the present invention.
Figure 5:
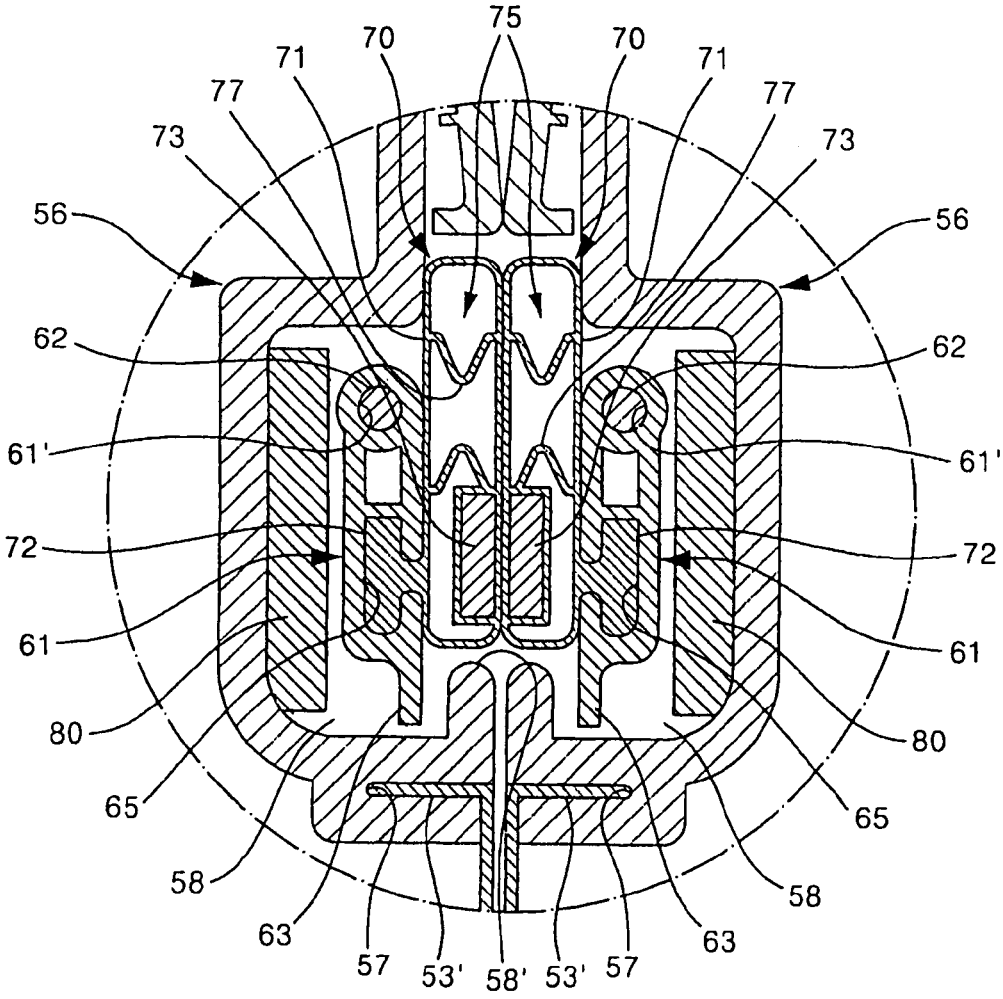
FIG. 5 is a sectional view of a major portion of the embodiment according to the present invention.

FIG. 4 shows a cross sectional view of gaskets for a refrigerator and a storage space sealing structure using the same according to a preferred embodiment of the present invention; and FIG. 5 shows an enlarged view of a major portion according to the embodiment of the present invention.

Referring to the figures, a storage space 48 defined in a refrigerator main body is opened and closed by first and second doors 50 and 50'. The first and second doors 50 and 50' are connected to both ends of the refrigerator main body through hinge assemblies, respectively, and the storage space 48 is closed as a state shown in FIG. 4 where distal ends of the respective doors are in contact with each other.

An external appearance of each of the first and second doors 50 and 50' is defined by an outer plate 51 and a door liner 54. An insulating layer 55 is formed in each of the first and second doors 50 and 50'. The outer plates 51 mainly define front surfaces of the doors 50 and 50'. The outer plate 51 comprises a front surface portion 52 defining the front surface of each of the doors 50 and 50' and a side surface portion 53 bent from the front surface portion 52 at a substantially right angle and defining a portion of a side surface of each of the doors 50 and 50'. A distal end of each side surface portion 53 is formed with an insertion flange portion 53' which is substantially parallel with the front surface portion 52. A portion at which the front surface portion 52 and the side surface portion 53 are connected to each other is preferably formed in a round shape.

The door liners 54, which define rear surfaces of the doors 50 and 50', are positioned in the storage space 48 when the doors 50 and 50' are closed. The door liners 54 are provided with accommodation pockets for accommodating stored goods.

A door bracket 56 is installed on each of the side surfaces of the doors 50 and 50' facing each other between the side surface portion 53 of the outer plate 51 and the door liner 54. The door bracket 56 with a predetermined width has a length corresponding to that from an upper end to a lower end of each of the doors 50 and 50'. The width of the door bracket 56 corresponds to a length between the side surface portion 53 and the door liner 54 in the side surface of each of the doors 50 and 50'. The door brackets 56 are installed so that surfaces thereof are exposed from the side surfaces of the doors 50 and 50'.

An insertion groove 57 is formed in each of the door brackets 56 at a position corresponding to the outer plate 51. The insertion groove 57 is a portion into which the insertion flange portion 53 of the outer plate 51 is inserted. The insertion groove 57 extends in the lengthwise direction of the door bracket 56. A flange portion 57', which is brought into close contact with an inner surface of each of the door liners 54, is formed at a side opposite to the insertion groove 57. The close contact flange portion 57' is shaped so as to come into close contact with the corresponding portion of the door liner 54. The close contact flange portion 57' also extends in the lengthwise direction of the door bracket 56. A structure for fastening the close contact flange portion 57' and the door liner 54 to each other may be provided therebetween.

Surfaces of the door brackets 56, i.e. surfaces of the doors 50 and 50' which are exposed to the outside, are formed with installation spaces 58, respectively. The installation space 58 also extends in a longitudinal direction of the door bracket 56 and is depressed into the insulating layer 55. The installation space 58 may extend up to both ends of the door bracket 56. However, it is not necessarily so, that is, the installation space 58 may extend only to positions slightly short of both ends of the door bracket 56. As shown in the figures, the installation space 58 is formed so that a sectional width of an inner side thereof is relatively wider than that of an inlet thereof. That is, a stopper 58' is formed along a side of the inlet of each installation space 58.

A gasket holder 61 is installed in each of the installation spaces 58. The gasket holder 61 extends in a longitudinal direction thereof in the same manner as the door bracket 56. A hinge hole 61' is bored through an end of each of the gasket holders 61. A hinge shaft 62 formed on the door bracket 56 is inserted into the hinge hole 61'. The hinge holes 61' are formed relatively adjacent to the storage space 48 when the gasket holders 61 are shown as a cross sectional view.

The gasket holders 61 are provided with distal ends pivoting about the hinge shafts 62, respectively. Particularly, the gasket holders 61 are supported by elastic members not shown, and thus tend to rotate about the hinge shafts 62 in the directions so that the distal ends of the gasket holders 61 protrude out of the installation spaces 58. There are provided catching stoppers 63 at the respective distal ends of the gasket holders 61, i.e., at ends opposite to the hinge holes 61'. The catching stopper 63 extends along the whole of the gasket holder 61. However, it is not necessarily so, that is, the catching stoppers 63 may be formed at necessary portions according to design conditions. The catching stoppers 63 are caught on the stoppers 58' of the door brackets 56, and thus cause the gasket holders 61 not to protrude out of the installation spaces 58.

A mounting channel 65 is formed in each of the gasket holders 61 to extend in the lengthwise direction thereof. The mounting channel 65 is formed so that a width of an inlet thereof is narrower than that of an inner side thereof when shown as a sectional view. Each of the mounting channels 65 is formed with a side gasket 70, which will be described below.

The side gaskets 70, which are provided respectively on the side surfaces of the first and second doors 50 and 50' facing each other, come into close contact with each other, so that cold air can be prevented from leaking out between the side surfaces of the doors 50 and 50'. Each of the side gaskets 70 comprises a gasket main body 71 that is made of flexible material, e.g. rubber, with predetermined elasticity. The gasket main body 71 is formed to extend in a longitudinal direction such that it has a length enough to prevent cold air from leaking out between the opposite doors 50 and 50'.

The gasket main bodies 71 are formed with mounting ribs 72 which protrude to be inserted into the mounting channels 65 of the gasket holders 61, respectively. The mounting rib 72 has a cross section corresponding to that of the mounting channel 65. Accordingly, when the mounting rib 72 is inserted into the mounting channel 65, the mounting rib 72 is hardly detached from the mounting channel 65, which has the relatively narrow inlet.

Each of the gasket main bodies 71 is provided with a magnet 73. The magnet 73 has the same length as the gasket main body 71. The respective magnets 73 should be installed in the gaskets 70 of the opposite doors 50 and 50' and different from each other in view of their polarities. The magnets 73 have a relatively narrow width so as to be positioned only at portions of surfaces of the gasket main bodies 71 that come into close contact with each other. The magnet 73 is provided at the portion of the gasket main body 71 biased toward an opposite side of the storage space 48.

That is, the magnets 73 are positioned at the portions of the gaskets 70 which are separated from each other first when the doors 50 and 50' are opened and come into contact with each other last when the doors 50 and 50' are closed. It is the reason why the portions of the gasket main bodies 71 provided with the magnets 73 have a relatively high hardness due to the magnets 73.

A portion of each gasket main body 71 in which the magnet 73 is not installed is formed with an elastic portion 75. The elastic portion 75 is provided with elastic connection portions 77 through which both ends of the interior of the gasket main body 71 are connected. The elastic connection portions 77 cause the elastic portion 75 to have a predetermined elasticity. That is, although the elastic portions 75 come into contact with and are separated from each other repeatedly, the elasticity is maintained.

A spacer 80 is installed in each of the installation spaces 58 of the door brackets 56. The spacers 80 are filled in the installation spaces 58 and thus serve to relatively reduce volumes of the installation spaces 58. It is for the purpose of minimizing contact between the cold air and the outer air or leakage of the cold air through the installation spaces 58. The spacer 80 is made of material having predetermined cushion, and thus causes noise and collision not to occur even if the gasket holder 61 collides thereagainst during pivoting.

Reference numeral 82 not described designates door covers. The door covers 82 are fixed to the door brackets 56 by allowing fixing hooks (not shown) provided on inner surfaces of the door covers 82 to be inserted into fixing grooves (not shown) formed in the door brackets 56, respectively.

Hereinafter, the operation of the gasket for a refrigerator and the storage space sealing structure using the same according to the present invention so configured will be described in detail.

First, in the gasket 70 of the present invention, the magnet 73 is provided at only a portion of the gasket main body 71 which comes into contact with the counterpart gasket 70. Particularly, the magnets 73 are not provided at the elastic portions 75 of the gasket main bodies 71, which first come into contact with each other and are last separated from each other when the doors 50 and 50' are opened and closed. The elastic portion 75 of the gasket main body 71 in which the magnet 73 is not provided is formed with the elastic connection portions 77, and thus, the predetermined elasticity is maintained.

Since the elastic portions 75 have the predetermined elasticity, the elastic portions 75 are elastically deformed and restored when the gaskets come into contact with each other and are separated from each other, thus preventing damage thereof. Of course, with the restoring force of the elastic portions 75, the magnets 73 bring the gaskets 70 into close contact with each other securely.

Figure 6:
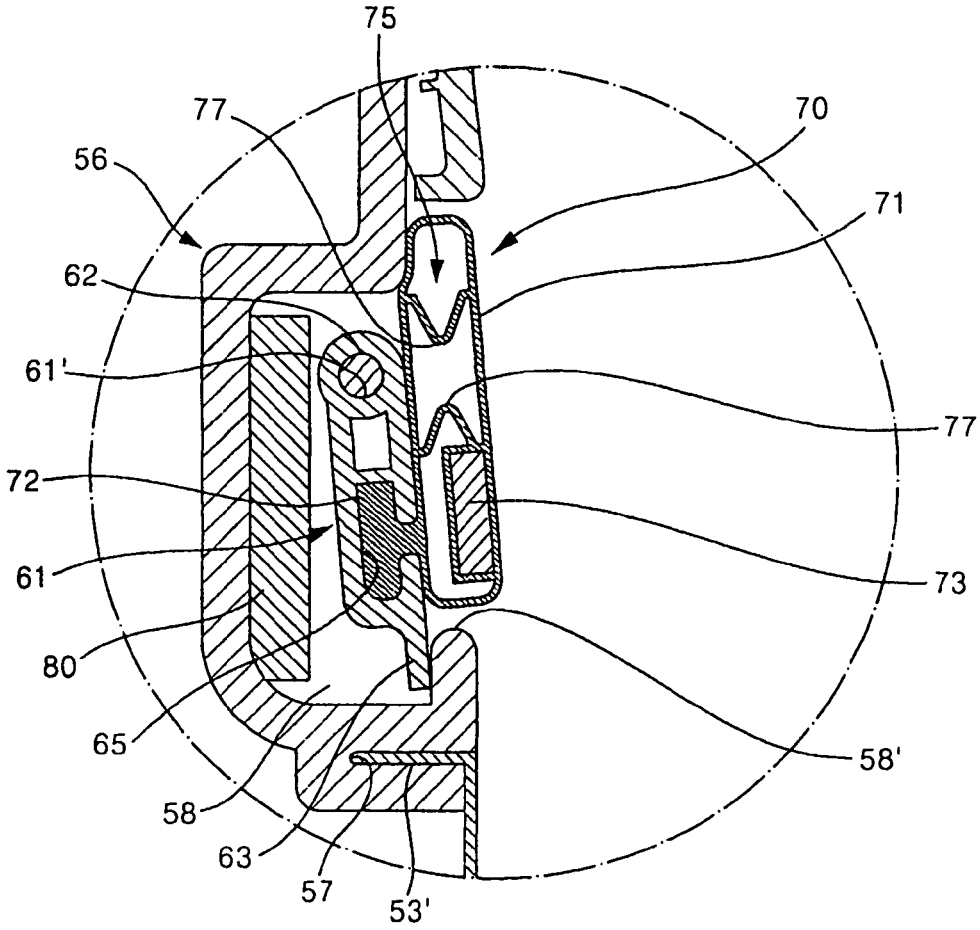
FIG. 6 is a view showing an operation of a gasket and a gasket holder in a state where a door is opened in the embodiment according to the present invention.

Both the doors 50 and 50' simultaneously or any one of them may be opened and closed. When both the doors 50 and 50' or any one of them is opened, the gasket holders 61 pivot about the hinge shafts 62 by restoring forces of the elastic members, so that the gaskets 70 protrude somewhat from the side surfaces of the doors 50 and 50', as shown in FIG. 6. The catching stoppers 63 are caught on the stoppers 58', so that the gasket holders 61 are prevented from further rotating.

In such a state, when the doors 50 and 50' are closed, the gaskets 70 provided on the side surfaces of the doors 50 and 50' facing each other come into close contact with each other, and thus, cold air is prevented from leaking out. At this time, the elastic portions 75 of the gaskets 70 first come into contact with each other, the contact area continuously increases, and then, the gaskets 70 fully come into contact with each other. When the doors 50 and 50' are completely closed, the magnets 73 are stuck to each other and the elastic portions 75 are also restored somewhat and come into close contact with each other, as shown in FIG. 5. Thus, the cold air is blocked from leaking out through between the side surfaces of the doors 50 and 50'.

In the meantime, when the doors 50 and 50' are opened, the portions provided with the magnets 73 separated firstly from each other. That is, as the doors 50 and 50' are opened, the portions of the gasket main bodies 71 that have been in close contact with each other by the magnets 73 are first separated from each other, and gradually, the elastic portions 75 are separated from each other. Of course, there may be provided an additional structure for separating the magnets 73, which are stuck to each other.

When the doors 50 and 50' are opened, the portions of the gasket main bodies 71, which lastly come apart from each other, become the elastic portions 75 that are pressed to each other and elastically deformed to a certain degree by means of the doors 50 and 50' and then restored to a state shown in FIG. 6.

The spacers 80 are installed in the installation spaces 58 of the door brackets 56, so that the spacers 80 do not hinder the gasket holders 61 from pivoting and reduce the volumes of the installation spaces 58. Thus, the spacers 80 serve to prevent the cold air from leaking out through the installation spaces 58 and to minimize the contact between the cold air and the outer air. In addition, since the spacers 80 have a cushioning function, collision energy can be absorbed without noises even though the gasket holders 61 collide against the spacers 80.

According to the gasket for a refrigerator and the storage space sealing structure using the same of the present invention so configured, the following advantages can be expected.

First, while the gasket of the present invention is stuck to the counterpart gasket using the magnetic force of the magnets, the gasket is provided with the elastic portion, in which a magnet is not installed, in order to prevent the flexibility of the gasket main body from deteriorating by the magnet. Thus, the gasket is hardly damaged even though the gasket is used for a long time, so that there is an advantage in that the durability of the gasket is improved.

Furthermore, according to the present invention, there is provided the spacer, which does not hinder the pivoting of the gasket holder installed in the installation space of the door bracket provided in the side surface of the door, minimizes the volume of the installation space, and absorbs the collision energy when the gasket holder collides against the spacer. Thus, there is an advantage in that the noise caused from the gasket holder does not occur when the door is opened and closed.

In addition, since the spacer installed in the installation space of the door bracket minimizes the volume of the installation space, there are advantages in that the installation space is prevented from being a passage for the leakage of the cold air and the contact between the outer air and the cold air is prevented.

The scope of the present invention is not limited to the embodiment described above but is defined by the appended claims. It will be apparent that those skilled in the art can make various modifications and changes thereto within the scope of the invention. Therefore, the true scope of the present invention should be defined by the appended claims.

What is claimed is:

1. A storage space sealing structure for a refrigerator, the refrigerator having a storage space in a main body of the refrigerator, the storage space sealing structure comprising:

a pair of doors for exposing and veiling the storage space, each of the doors having a lateral side, the lateral sides of the doors facing each other when the doors are closed, each of the doors having an installation space extending along the corresponding lateral side, respectively;

a pair of gasket holders, each of the gasket holders being installed in a corresponding on of the installation spaces and being pivotable therein;

a pair of gaskets, each of the gaskets being located on a corresponding one of the gasket holders, each of the gaskets including:

a gasket main body having a front contact side portion and a rear side portion opposite to the front contact side portion;

a magnet located in the gasket main body; and an elastic connection portion located in the gasket main body, the elastic connection portion extending from the front contact side portion to the rear side portion; and a pair of cushion members each disposed in a corresponding one the installation spaces and cushioning against pivoting of the corresponding gasket holder and reducing air leakage through the corresponding installation space, each of the cushion members being separate and spaced from the corresponding gasket.

2. The storage space sealing structure as claimed in claim 1, further comprising a pair of concave door brackets respectively inserted into the lateral sides of the doors, the installation spaces being defined by the concave door brackets, each of the cushion members being in contact with an inner surface of the corresponding door bracket.

3. The storage space sealing structure as claimed in claim 1, wherein a free end of each of the gasket holders is formed with a catching stopper which is engageable with a stopper formed on an inlet of the corresponding installation space, whereby the free end of each of the gasket holders is prevented from protruding out of the corresponding installation space.

4. The storage space sealing structure as claimed in claim 1, wherein each of the gaskets comprises:

a mounting rib formed on the rear side portion of the gasket main body and inserted into and caught by the corresponding gasket holder.

5. The storage space sealing structure as claimed in claim 4, wherein each of the elastic connection portions reinforces elasticity of a corresponding one of the gasket main bodies in a direction from the front contact side portion to the rear side portion of the corresponding gasket main body.

6. The storage space sealing structure as claimed in claim 1, wherein each of the cushion members is provided at least on an inner surface of the corresponding installation space opposite an end of the corresponding gasket holder.

7. The storage space sealing structure as claimed in claim 1, wherein each of the cushion members is spaced apart from the corresponding gasket holder after the doors are closed.

8. The storage space sealing structure as claimed in claim 7, wherein the front contact side portions of the gaskets forming a contact interface after the doors are closed.

9. The storage space sealing structure as claimed in claim 8, wherein each of the magnets is located on the front contact side portion of a corresponding one of the gasket main bodies.

* * * * *